US011774202B2

(12) United States Patent
Alvarez

(10) Patent No.: US 11,774,202 B2
(45) Date of Patent: Oct. 3, 2023

(54) GUN CONTROL UNIT

(71) Applicant: Montana M Alvarez, Desert Center, CA (US)

(72) Inventor: Montana M Alvarez, Desert Center, CA (US)

( * ) Notice: Subject to any disclaimer, the term of this patent is extended or adjusted under 35 U.S.C. 154(b) by 0 days.

(21) Appl. No.: 17/729,718

(22) Filed: Apr. 26, 2022

(65) Prior Publication Data

US 2022/0341693 A1 Oct. 27, 2022

Related U.S. Application Data

(60) Provisional application No. 63/179,720, filed on Apr. 26, 2021.

(51) Int. Cl.
*F41A 19/59* (2006.01)

(52) U.S. Cl.
CPC ..... *F41A 19/59* (2013.01)

(58) Field of Classification Search
CPC ..... F41A 19/09; F41A 19/00; F41A 19/03; F41A 19/04; F41A 19/58; F41A 19/63; F41A 19/66; F41A 19/65; F41A 19/64; F41A 19/68; F41A 19/69; F41A 19/59; F41A 7/08; F41A 7/10; F41G 3/04
USPC ..... 89/27.3, 1.41, 12
See application file for complete search history.

(56) References Cited

U.S. PATENT DOCUMENTS

| | | | | |
|---|---|---|---|---|
| 2,596,143 | A * | 5/1952 | Gilbreath | F41A 31/00 73/167 |
| 3,263,565 | A * | 8/1966 | Dragonetti | F41F 1/10 89/1.804 |
| 5,949,015 | A * | 9/1999 | Smith | F41G 3/22 89/41.09 |
| 10,557,683 | B1 * | 2/2020 | Staffetti | F41G 3/165 |
| 2012/0174741 | A1 * | 7/2012 | Rogers | F41A 27/28 451/340 |

* cited by examiner

*Primary Examiner* — John Cooper
(74) *Attorney, Agent, or Firm* — Barry Choobin; Patent 360

(57) ABSTRACT

A gun control unit that can retrofit to any existing firearm or be integrated into a firearm to allow a user to fire a round or rounds through rotation instead of pressing or pulling a trigger, to maximize the use and effectiveness of ammunition. The gun control unit includes an electric rotary trigger and an actuator both operably coupled to each other. The rotation of the electric rotary trigger actuates the actuator which in turn triggers the firing mechanism of the firearm. The operation of the actuator is controlled by a microcontroller that contains a programmable sequenced interval.

16 Claims, 6 Drawing Sheets

GUN CONTROL UNIT

CROSS-REFERENCE TO RELATED APPLICATIONS

This application claims priority from the U.S. provisional patent application Ser. No. 63/179,720, filed on Apr. 26, 2021, which is incorporated herein by reference in its entirety.

FIELD OF INVENTION

The present invention relates to a firearm, and more particularly, the present invention relates to an electronic rotary trigger for firearms.

BACKGROUND

Firearms are becoming popular around the world for a variety of reasons including self-protection and sports. Considering the increasing use of firearms, a need is there to allow shooters to shoot their firearms at a specific firing sequence and have more control over their ammunition expense.

SUMMARY OF THE PRESENT INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a gun control unit for firearms that can control the firing rate and the number of shots fired.

It is another object of the present invention that the gun control unit can be retrofitted into any existing firearm or integrated into any firearm.

It is still another object of the present invention that the gun control unit makes the operation of firearms cost-effective by saving ammunition.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent The following detailed description is merely exemplary and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

Figure 2:
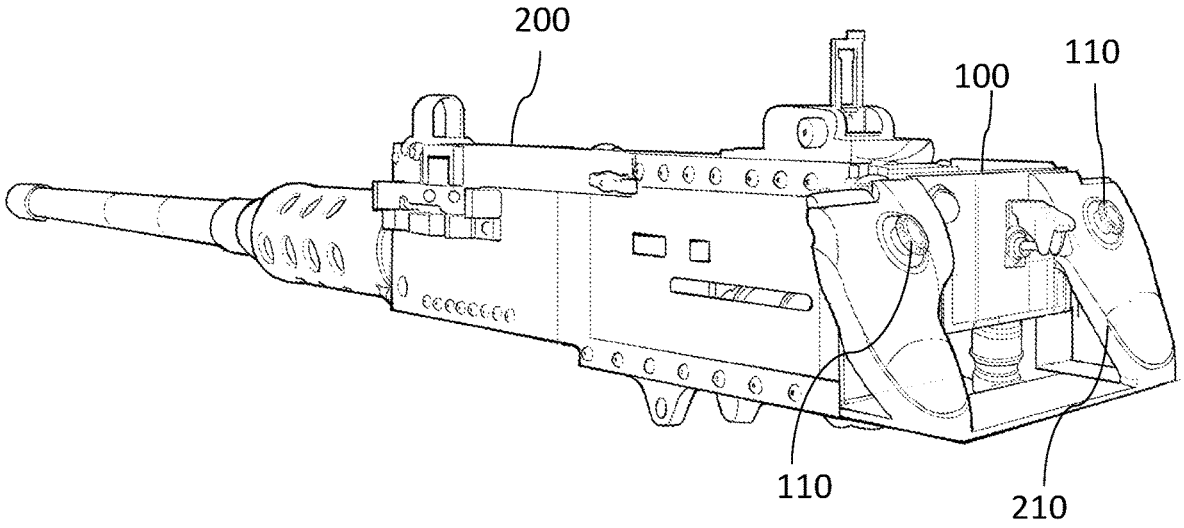
FIG. 2 is a perspective view of the firearm with the disclosed gun control unit, in accordance with an exemplary embodiment of the present invention.

All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 2. Furthermore, there is no intention to be bound by any expressed or implied theory presented in the preceding technical field, background, summary, or in the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

Disclosed is a gun control unit for firearms to replace the traditional pull trigger with an electric rotary trigger. The electric rotary trigger can control the firing rate and the number of ammunitions fired. The disclosed gun control unit can be retrofitted to an existing firearm as well as be permanently integrated into a firearm. The drawings show Browning's M2 .50 caliber firearm as the firearm for illustration only, however, it is understood that any firearm is within the scope of the present invention.

Figure 1:
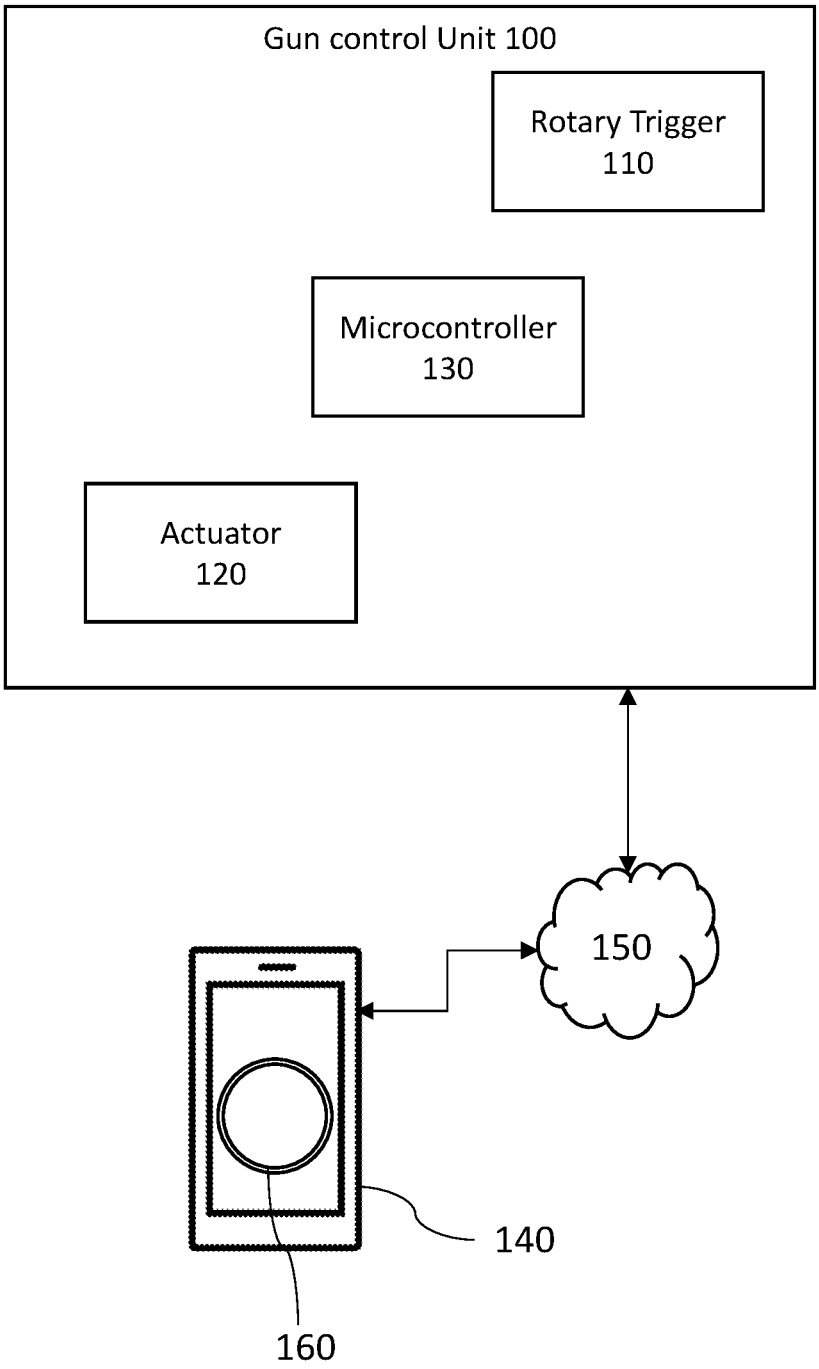
FIG. 1 is a block diagram illustrating an exemplary embodiment of the disclosed gun control unit for firearms, in accordance with an exemplary embodiment of the present invention.
Figure 6:
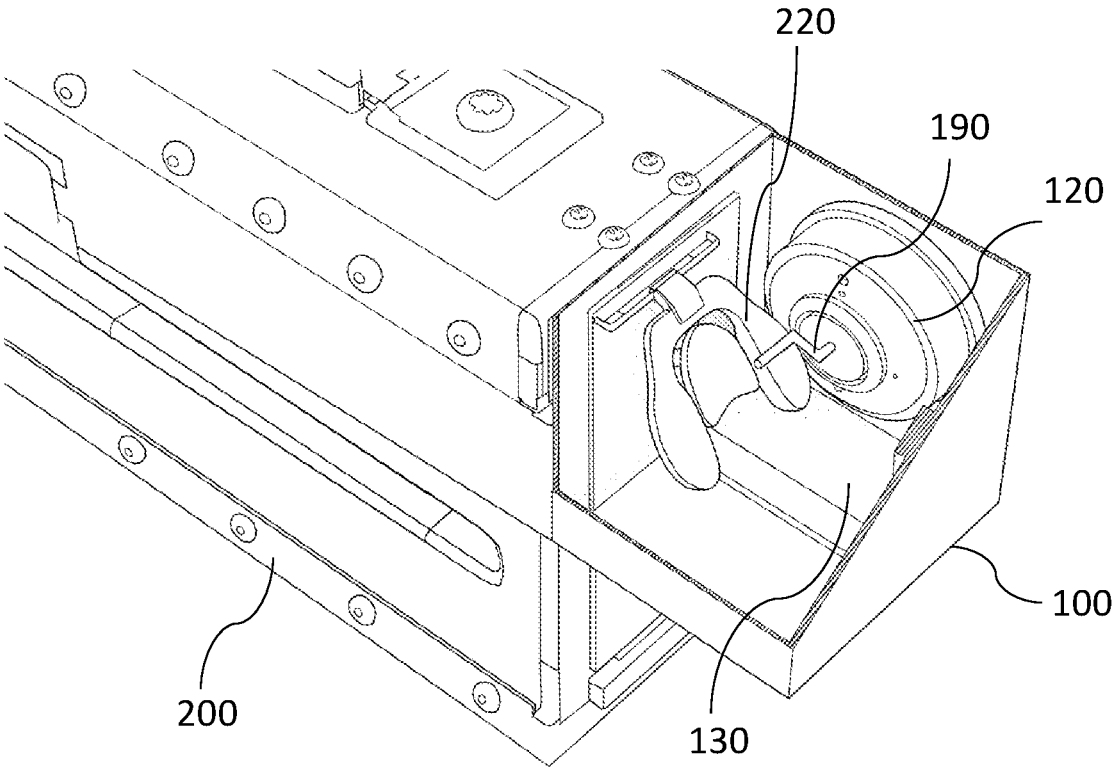
FIG. 6 is a cut out view of the disclosed gun control unit, in accordance with an exemplary embodiment of the present invention.

Referring to FIG. 1, which is a block diagram illustrating an exemplary embodiment of the disclosed gun control unit 100 for controlling the firing rate of a firearm. The gun control unit 100 can include an electric rotary trigger 110 that can be manually rotated in a clockwise or counterclockwise fashion to a certain degree of angle, to fire a round or rounds depending upon the programmable sequenced interval. The rotary trigger can activate the firearm when the rotary trigger is rotated. A degree scale can be associated with the rotary trigger 110 which can include degrees, and the rotary trigger 110 can be rotated to any degree on the scale. The degrees of rotation or number of rotations can define the firing rate of the firearm. Moreover, the electric rotary trigger 110 may return to its original position after completing the rounds of firing. Referring to FIG. 6, which the gun control unit 100 can also include an actuator 120, also referred to herein as the actuation unit, that can be engaged by operation of the rotary trigger 110, wherein the actuation unit 120 is operably coupled to a firing mechanism of the firearm, and the actuation unit 120 can result in actuation of the firing mechanism for firing shots. The actuation unit 120 can include a microcontroller 130 that can include a programmable sequenced interval based on which the actuation unit 120 works.

Furthermore, shown in FIG. 1 is an external remote device 140, that can be a smartphone, remote control, or the like. The remote device 140 can be connected to the disclosed gun control unit 100 through a network 150. The network 150 can be wired or wireless. Examples of wireless network include Wi-Fi and Bluetooth™. The rotary trigger 110 can be implemented as a soft rotary trigger 160 implemented through a suitable interface on the remote device 140. The soft rotary trigger 160 can be actuated to mimic the operation of the electric rotary trigger 110.

Figure 3:
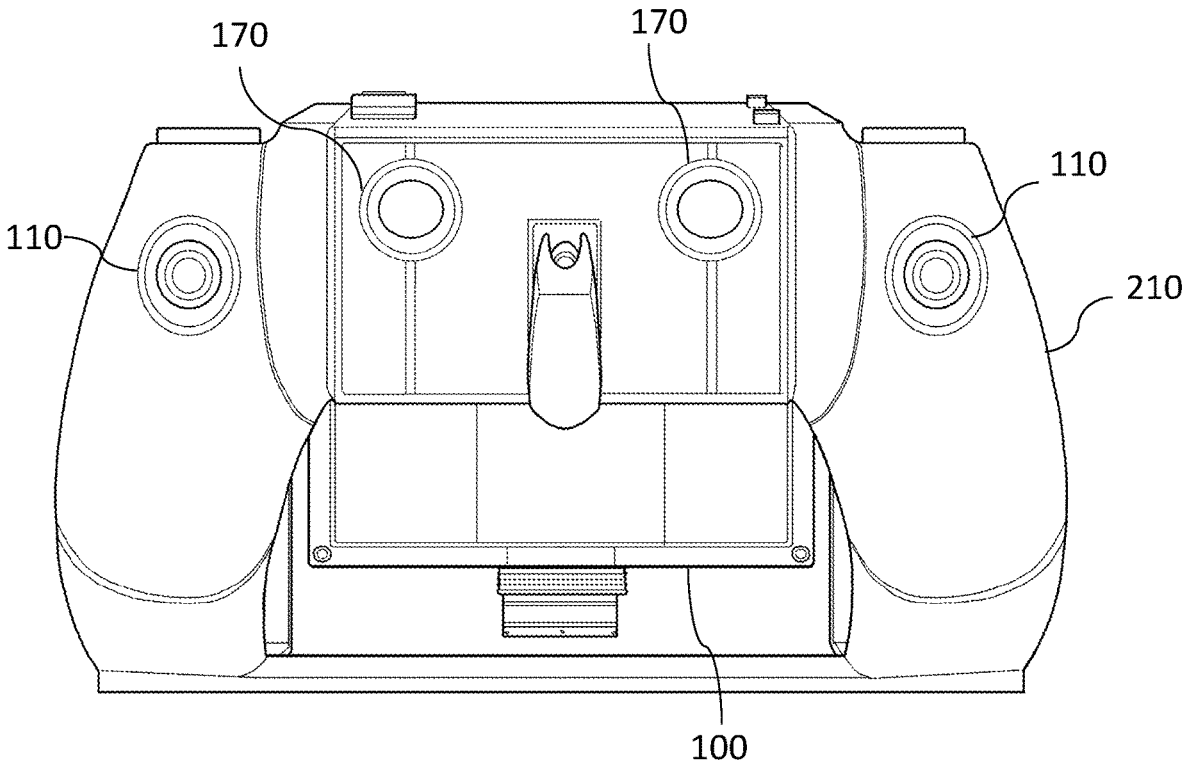
FIG. 3 is a rear view of the firearm showing the electric rotary trigger of the gun control unit, in accordance with an embodiment of the present invention.
Figure 4:
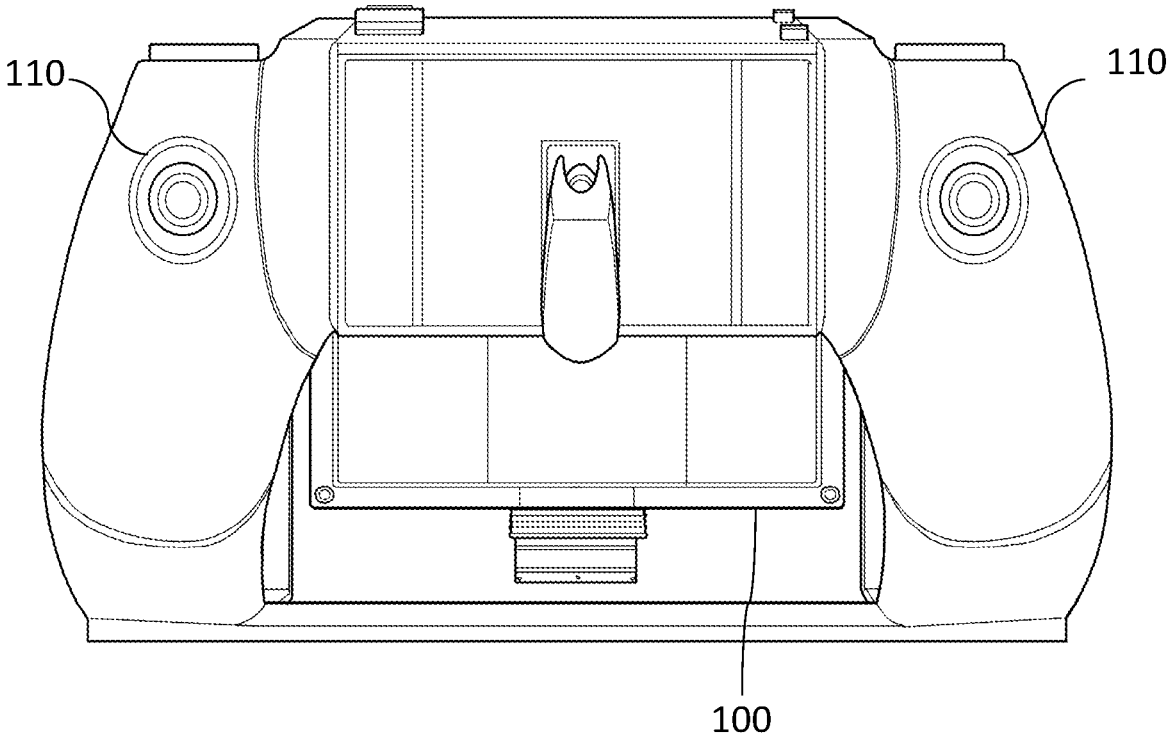
FIG. 4 is a rear view of the firearm without pushbuttons and only having the electric rotary trigger, in accordance with an embodiment of the present invention.
Figure 5:
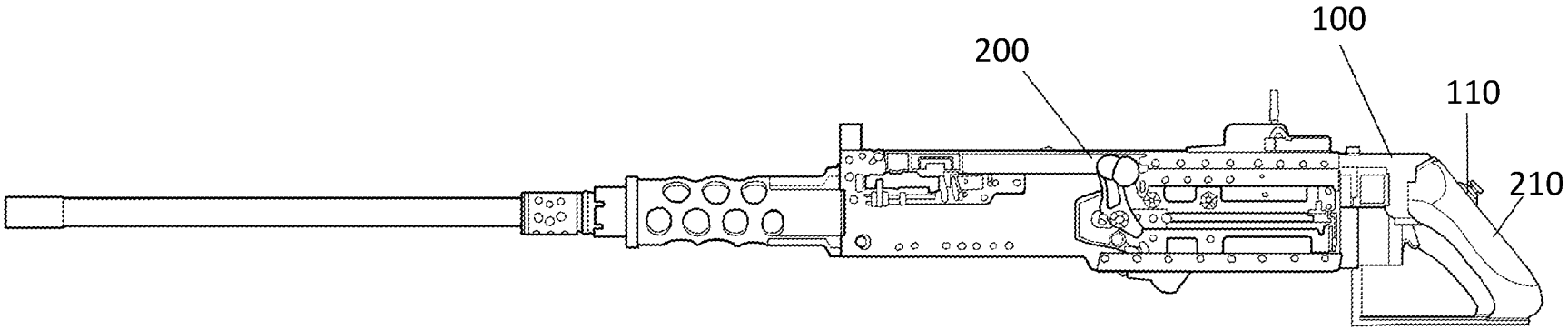
FIG. 5 is a side view of the firearm with the disclosed gun control unit, in accordance with an exemplary embodiment of the present invention.

Referring to FIGS. 2-5 which show the disclosed electric rotary trigger gun control unit 100 mounted to a firearm 200. The electric rotary trigger gun control unit 100 can include an electric rotary trigger 110 that can be manually rotated, in a clockwise or counterclockwise fashion to a certain degree of angle, to fire a round or rounds depending upon the programmable sequenced interval. The electric rotary trigger 110 can be provided nearby the handle 210 of the firearm 200, such that to be within reach of the hand while operating the firearm. As shown in FIG. 4, the electric rotary trigger 110 can be provided just above the handle 210, such that a person while holding the handle 210 of the firearm 200 can rotate the electric rotary trigger 110 using a thumb in either clockwise or counterclockwise direction. The firearm 200 shown in the drawings has two handles 210 so that the firearm 200 can be held by both hands, and so the two electric rotary triggers 110 can be provided for the two handles 210, and either hand can operate the electric rotary trigger 110.

The disclosed electric rotary trigger gun control unit 100 can further include a trigger arm 190 that can be housed in the gun control unit 100 along with the electronics or microcontroller 130 such that the trigger arm 190 is connected to the actuator 120. The actuator 120 can be, but not limited to, a solenoid or motor and can be housed within the gun control unit 100/housing itself, as shown in FIGS. 3, 4, and 6.

In certain implementations, rotation of the electric rotary trigger 110 either clockwise or counterclockwise can send a signal to the actuator 120. The actuator which is coupled to a firing mechanism of the preexisting firearm by way of the firearm's trigger bar, bolt, sear, firing pin, firing pin bar, rotor, hammer, or any other part that is integral to the firearm's firing operation 220 can cause firing based on the programmable sequenced interval. The electric actuator upon receiving the signal can actuate the firing mechanism to fire a round or rounds from the firearm in accordance with the programmable sequenced interval. It is understood that the programmable sequenced interval of the microcontroller can be programmed as and when desired.

In the configuration of the invention being an attachment for preexisting platforms, the invention can replace an existing trigger and/or gun control unit of the firearm. Shown in FIG. 6. is the preexisting trigger 220 which can be housed or contained within the gun control unit 100/housing, and the gun control unit 100/housing attached to the firearm 200, with the trigger arm 190 which will be connected to an actuator 120 and able to engage the preexisting trigger 220 respectively by either pulling, pushing, or rotating the trigger to discharge the firearm 200. For example, in FIG. 6, the Browning's M2 .50 Caliber trigger is within the gun control unit 100 on the rear of the weapon system and is activated/engaged with the actuator's trigger arm 190. In turn, when the user manually rotates the electric rotary trigger 110, power will flow to the actuator 120, for example, but not limited to, a motor or solenoid, within the gun control unit 100 that would either push, pull, or rotate the preexisting trigger 220 of the firearm 200.

The electric rotary trigger 110 when rotated can signal the actuator 120 within the gun control unit 100 to actuate the preexisting firearm's firing mechanism 220, such as a trigger, via a trigger arm 190. The trigger arm 190 can be either affixed directly to the preexisting trigger or shall come in contact with it directly but not be fixed to the preexisting trigger itself. The effectiveness and overall control of the firearm depends on the configuration of the disclosed gun control unit 100. In one implementation, the movement of the electric rotary trigger 110 can signal to the actuator 120 which in turn moves the trigger arm 190 to set off the preexisting trigger, by either pushing, pulling, or rotating the firing system's preexisting trigger 220 to disengage the firearm 200. In another implementation, the movement of the electric rotary trigger or the depression of a push-button trigger 170 can deliver power to the electric actuator which in turn moves the trigger arm to set off the preexisting trigger, by either pushing, pulling, or rotating the firing system's preexisting trigger to disengage the firearm. In another implementation, the use of the electric rotary trigger permits optimum use of the tracer firing technique as the release of each round of ammunition is directly dependent upon the user's actuation of the electric rotary trigger, which allows for greater user control over rounds per minute expended. In another implementation, the use of the electric rotary trigger permits greater effective use of ammunition as the release of each round of ammunition is directly dependent upon the user's movement of the electric rotary trigger allowing user control over rounds expended before the intended target is achieved.

The disclosed electric rotary trigger can be advantageous by allowing a user to fire rounds through rotation, which can avoid the situation that the traditional push/pull-button trigger is susceptible to i.e., lack of rate of fire control of the firearm. The disclosed electric rotary trigger makes firing more efficient providing a means of target acquisition while expending fewer rounds and therefore avoiding waste of ammunition.

Referring to FIG. 6 which shows an exemplary embodiment of the gun control unit 100 that includes the actuator 120 and a microcontroller 130 encased within a housing of the gun control unit 100. A preexisting or standard trigger 220 can also be seen as a part of the firing mechanism of the firearm 200. The actuator 120 is shown operably coupled to the standard trigger 220 of the firearm 200 by a trigger arm 190 of the disclosed gun control unit 100, wherein the actuator 120 can cause the trigger arm 190 to operate the standard trigger 220 causing firing of the shots.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A gun control unit for a firearm to control the firing, the gun control unit comprising:

an electric rotary trigger configured to be rotated clockwise or counterclockwise; and an actuator operably coupled to the electric rotary trigger, wherein the actuator is also operably coupled to a firing mechanism of the firearm, wherein the rotation of the electric rotary trigger is configured to operate the actuator, wherein the actuator is configured to trigger the firing mechanism of the firearm, wherein the electric rotary trigger is configured to be mounted to the firearm nearby a handle of the firearm such that while holding the firearm with a hand around the handle, the electric rotary trigger is within reach of a thumb of the hand.

2. The gun control unit according to claim 1, wherein the gun control unit further comprises a microcontroller configured with programmable sequenced intervals, wherein the microcontroller is operably coupled to the actuator, wherein the actuator is configured to trigger the firing mechanism based on the programmable sequenced intervals.

3. The gun control unit according to claim 2, wherein the programmable sequenced intervals are configured to define a number of shots that can be fired based on a degree of rotation of the electric rotary trigger.

4. The gun control unit according to claim 2, wherein the microcontroller is further configured to receive a signal from an external remote device, wherein the signal is generated by rotation of a soft electric rotary trigger implemented through an interface on the external remote device, wherein the signal comprises information about degree of rotation of the electric rotary trigger, wherein the microcontroller is configured to actuate the actuator upon receiving the signal.

5. The gun control unit according to claim 1, wherein the firing mechanism of the firearm comprises a standard trigger of the firearm, wherein the actuator is configured to push or pull the standard trigger.

6. The gun control unit according to claim 1, wherein the gun control unit can further comprise a push-button, in conjunction with the electric rotary trigger, configured to be actuated for powering the actuator.

7. The gun control unit according to claim 1, wherein the firing mechanism is a bolt, sear, firing pin, firing pin bar, trigger bar, hammer or any other part of the firearm that is integral to the operation of the firing sequence of the firearm.

8. A firearm comprising:

a gun control unit to control the firing, the gun control unit comprising:

an electric rotary trigger configured to be rotated clockwise or counterclockwise; and an actuator operably coupled to the electric rotary trigger, wherein the actuator is also operably coupled to a firing mechanism of the firearm, wherein the rotation of the electric rotary trigger is configured to operate the actuator, wherein the actuator is configured to trigger the firing mechanism of the firearm, wherein the electric rotary trigger is mounted nearby a handle of the firearm such that while holding the firearm with a hand around the handle, the electric rotary trigger is within reach of a thumb of the hand.

9. The firearm according to claim 8, wherein the gun control unit further comprises a microcontroller configured with programmable sequenced intervals, wherein the microcontroller is operably coupled to the actuator, wherein the actuator is configured to trigger the firing mechanism based on the programmable sequenced intervals.

10. The firearm according to claim 9, wherein the programmable sequenced intervals are configured to define a number of shots that can be fired based on a degree of rotation of the electric rotary trigger.

11. The firearm according to claim 9, wherein the microcontroller is further configured to receive a signal from an external remote device, wherein the signal is generated by rotation of a soft electric rotary trigger implemented through an interface on the external remote device, wherein the signal comprises information about a degree of rotation of the electric rotary trigger, wherein the microcontroller is configured to actuate the actuator upon receiving the signal.

12. The firearm according to claim 8, wherein the firing mechanism of the firearm comprises a standard trigger of the firearm, wherein the actuator is configured to push or pull the standard trigger.

13. The firearm according to claim 8, wherein the gun control unit can further comprise a push-button, in conjunction with the electric rotary trigger, configured to be actuated for powering the actuator.

14. The firearm according to claim 8, wherein the firing mechanism is a bolt, sear, firing pin, firing pin bar, trigger bar, hammer or any other part of the firearm that is integral to the operation of the firing sequence of the firearm.

15. A method for controlling a firing rate of a firearm, the method comprises the steps of:

providing a gun control unit for the firearm, the gun control unit comprises:

an electric rotary trigger configured to be rotated clockwise or counterclockwise, wherein the electric rotary trigger is mounted nearby a handle of the firearm, and an actuator operably coupled to the electric rotary trigger, wherein the actuator is also operably coupled to a firing mechanism of the firearm, wherein the rotation of the electric rotary trigger is configured to operate the actuator, wherein the actuator is configured to trigger the firing mechanism of the firearm;

holding the handle by a hand; and while holding the handle, rotating the electric rotary trigger using a thumb of the hand.

16. The method according to claim 15, wherein the gun control unit further comprises a microcontroller configured with programmable sequenced interval, wherein the microcontroller is operably coupled to the actuator, wherein the actuator is configured to trigger the firing mechanism of the firearm based on the programmable sequenced interval, wherein the programmable sequenced intervals are configured to define a number of shots that can be fired based on a degree of rotation of the electric rotary trigger.

* * * * *